US008273150B2

(12) United States Patent
Narayan

(10) Patent No.: US 8,273,150 B2
(45) Date of Patent: Sep. 25, 2012

(54) HIGH DIMENSIONAL CORED WIRES CONTAINING OXYGEN REMOVERS AND A PROCESS FOR MAKING THE SAME

(75) Inventor: Goda Surya Narayan, Orissa (IN)

(73) Assignees: Heraeus Electro-Nite International N.V., Houthalen (BE); Goda Surya Narayan, Orissa (IN)

( * ) Notice: Subject to any disclaimer, the term of this patent is extended or adjusted under 35 U.S.C. 154(b) by 775 days.

(21) Appl. No.: 12/374,395

(22) PCT Filed: Jul. 17, 2007

(86) PCT No.: PCT/EP2007/006323

§ 371 (c)(1),
(2), (4) Date: Jan. 20, 2009

(87) PCT Pub. No.: WO2008/009414

PCT Pub. Date: Jan. 24, 2008

(65) Prior Publication Data

US 2010/0037730 A1 Feb. 18, 2010

(30) Foreign Application Priority Data

Jul. 20, 2006 (IN) ..... 725/KOL/2006
Mar. 23, 2007 (IN) ..... 725/KOL/2006

(51) Int. Cl.
*C21C 7/04* (2006.01)

(52) U.S. Cl. ..... 75/562; 148/595

(58) Field of Classification Search ..... 75/562; 148/595

See application file for complete search history.

(56) References Cited

U.S. PATENT DOCUMENTS 3,915,693 A 10/1975 Rasmussen
4,486,227 A * 12/1984 Douchy et al. ..... 75/526
4,584,169 A 4/1986 Werner et al.
4,832,742 A * 5/1989 Ototani ..... 75/304

FOREIGN PATENT DOCUMENTS

| | | | |
|---|---|---|---|
| CN | 14898975 | A | 5/2004 |
| EP | 0034994 | A1 | 9/1981 |
| EP | 0066305 | A1 * | 12/1982 |
| FR | 2796398 | A1 * | 1/2001 |
| GB | 892375 | A | 3/1962 |
| GB | 2416174 | A | 1/2006 |
| JP | 49-089618 | A | 8/1974 |
| JP | 60-234795 | A | 11/1985 |
| JP | 07-126735 | A | 5/1995 |
| NL | 9001749 | A | 3/1992 |
| RU | 2 151 199 | C1 | 6/2000 |

OTHER PUBLICATIONS

Grassi, P. Derwent Acc No. 2001-126339 for Patent Family including FR 2796398 A1, published Jan. 19, 2001.*
Grassi, P. Machine translation for FR 2796398 A1, published Jan. 19, 2001.*
Oelschlagel, D. et al; "Treating steel with Ferrokal wire"; Iron and Steel International; vol. 54; No. 6; Dec. 1981; pp. 323-330.
English Translation of Russian Examination Report issued on Oct. 6, 2010 in Int'l Application No. PCT/EP2007/006323.
Office Action issued Jan. 24, 2012 in JP Application No. 2009-519859 (with English translation).

* cited by examiner

*Primary Examiner* — George Wyszomierski
*Assistant Examiner* — Tima M McGuthry Banks
(74) *Attorney, Agent, or Firm* — Panitch Schwarze Belisario & Nadel LLP

(57) ABSTRACT

A high dimensional cored wire is provided containing de-oxidant material arranged in a core of the wire, the de-oxidant material being in finely divided granular or powdery form coated with a protective coating material, the diameter of the cored wire varying between 13 and 40 mm. A process for manufacturing the wire is also provided.

20 Claims, No Drawings

HIGH DIMENSIONAL CORED WIRES CONTAINING OXYGEN REMOVERS AND A PROCESS FOR MAKING THE SAME

CROSS-REFERENCE TO RELATED APPLICATIONS

This application is a Section 371 of International Application No. PCT/EP2007/006323, filed Jul. 17, 2007, which was published in the English language on Jan. 24, 2008, under International Publication No. WO 2008/009414 A1 and the disclosure of which is incorporated herein by reference.

BACKGROUND OF THE INVENTION

The present invention relates to a high dimensional cored wire containing de-oxidant material (or oxygen remover). Furthermore the invention relates to a process for manufacturing a high dimensional cored wire.

De-oxidation plays an important role in the process of steel making, for which a number of deoxidants have been conventionally used. The term de-oxidant means a chemical compound, alloy or element which will remove the active oxygen present in the liquid metal (e.g., steel) and form an oxide as its final product, usually as a distinct phase and easily separable from the liquid metal. Oxygen, if present in steel in the active/elemental form, will result in pinholes and blowholes in the cast product as well as obstruct the process of continuously casting the steel in the modern continuous casting machines. Steel makers are in regular search of a better and more economical method for removing the oxygen in steel, which will ultimately reduce the consumption of deoxidants.

Conventionally, de-oxidation of steel was carried out by the addition of ferro alloys or aluminum ingots, bars or solid aluminum wire. For bars and ingots the recovery (i.e., ratio of actual quantity and theoretical amount of aluminum) was poor, resulting in greater aluminum consumption. In the case of aluminum wire, the recovery was better, but feeding time was greater, and often the wire could not reach the depth of the molten steel bath.

For doing the primary de-oxidation or the bulk removal of oxygen (primary killing) in steel from a higher level of, say, 800-2000 ppm and above, to a lower level of around 100-200 ppm, alloys such as "ferro-silicon," "ferro-manganese," "silico-manganese," and "coke" are used, though in bulk, and these materials have served the purpose fairly well. These ferro alloys or compounds have a limitation on the extent to which they can be used in steel making and are limited to the extent of the specification that is allowed in the steel. In almost all grades of steel, silicon and manganese elements are used in various forms for the primary de-oxidation, along with aluminum in various forms such as bars, ingots, cubes or solid wires, etc.

For secondary treatment of steel for the purpose of removing the remnant of oxygen, a number of de-oxidants selected from the group of aluminum, titanium and calcium silicide have been used. However, aluminum has been found to be the most suitable de-oxidant for two reasons, e.g., (i) affinity of aluminum for active oxygen and (ii) the requirement of presence of aluminum in predetermined amounts in some grades of steel in the cast product. Aluminum is capable of removing oxygen present in molten steel at very low levels of around 4 ppm or even less. It is also the most economical de-oxidizer element, alloy or compound known at present.

Previously, primary de-oxidation, apart from the use of ferro alloys, was carried out by the addition of aluminum ingots or bars and solid wires of dimension of 13 mm, and secondary or final de-oxidation by adding ingots, notch bars and sometimes even solid aluminum wire. Addition through solid aluminum wire results in a higher percentage of recovery of aluminum compared to bars and ingots. In this specification, unless otherwise specified, the term 'recovery' defines the ratio of the actual quantity of aluminum to be added to remove the active oxygen to the theoretical amount of aluminum required. For bars and ingots, the recovery was very poor and accordingly consumption of aluminum increased. In the case of solid aluminum wire, though the recovery was better than bars and ingots, feeding time was greater. The normal size of the aluminum wire that can be injected into the molten steel is around 3 ,6, 9, 13, or 16 mm.

The other problem encountered with solid aluminum wire is that due to the high temperatures encountered in steel making, aluminum becomes very soft due to the high temperatures and is not able to penetrate deeply into the molten steel bath which consequently results in lower recovery.

To solve a similar problem, it is proposed in Chinese patent application publication CN 1498975 A to feed aluminum cored wire directly into molten steel for deoxidizing.

A further method of adding aluminum to steel in a ladle for the purpose of de-oxidation is known from British patent application publication GB 892375. This method comprises progressively feeding a rod or wire of the material to be added at an appreciable depth below the surface of the steel. The material may be in powder or granular form enclosed in a steel tube.

A process for manufacturing cored wires containing deoxidizing constituents as pulverized material within a metal tube is known from U.S. Pat. No. 3,915,693.

BRIEF SUMMARY OF THE INVENTION

An object of the invention is to overcome the above drawbacks and provide a high dimensional cored wire as well as a process to manufacture a high dimensional cored wire.

The present invention attempts to overcome the above drawbacks and provides high dimensional cored wires containing de-oxidant material/oxygen removers, preferably formed from cold-rolled steel sheet, the de-oxidant material being in finely divided granular or powdery form at least partially coated with a protective coating material, such as herein described, the diameter of the cored wires varying between 13 and 40 mm, preferably between 19 and 34 mm. Preferably, the coated de-oxidant material filled in the core is held in place in compacted form by the seaming locks provided during formation of the cored wires after filling. The wire can also be made by totally welding the sheath so that there is no seam.

This invention also provides a process for producing the above cored wires containing the de-oxidant coated with a protective coat in a compacted form, ensuring better recovery and rapid feeding of the de-oxidant material in predetermined amounts.

In other words, the present invention relates to high dimensional cored wires containing de-oxidant material/oxygen removers and a process for making the same. More particularly, this invention pertains to high dimensional cored wires filled with an oxygen-removing material selected from the group of aluminum, titanium, zirconium and calcium silicide, preferably fine granules of reactive aluminum powder, having a coating of inorganic and/or organic material. The coating can also be a mixture or combination of different materials, or even without a coating and simple granules, and a process for preparing such high dimensional cored wires.

DETAILED DESCRIPTION OF THE INVENTION

For the high dimensional wires proposed in the present invention, feeding of higher dimension solid aluminum wire, as available now, becomes very difficult with the conventional wire feeders.

The present invention aims at overcoming the foregoing shortcomings of the prior art and at carrying out production of steel more effectively, maintaining an optimum level of aluminum in steel.

This invention has also the advantage of further enhancing the recovery of aluminum, simultaneously reducing the quantum of consumption and time of feeding of aluminum to liquid metal.

A further advantage of the present invention is to provide a technique to use aluminum scraps as de-oxidant after converting them into granules, followed by coating with a protective material like graphite, low density polyethylene, polyamide, low molecular weight vinyl acetate polymer, talc, steatite, calcium silicide, powdered lime, and the like to prevent fusion or adhesion of the granular particles into a single mass while being pressed and drawn into the wire. It is also possible to use the aluminum granules without coating.

A still further advantage of this invention is to provide high dimensional cored wires containing aluminum granules coated with graphite, which while being drawn through the forming machine, the contents become tightly packed, thereby imparting dimensional rigidity and stiffness to the wire.

Another advantage of the present invention is to provide a process for preparing high dimensional cored wires containing de-oxidants in granular form and coated with a protective coating to prevent sticking and fusing into a single mass while being pressed and drawn into wire. Further, during immersion of the wire into molten steel the wire begins to melt and the (organic) coating vaporizes rapidly, thus causing homogeneous and rapid spreading of the de-oxidant material within the molten steel.

The subject invention also relates to a process for preparing high dimensional cored wires containing de-oxidant material/oxygen removers as defined above, comprising especially the steps of:-

(a) slitting cold rolled steel sheet, preferably DD and soft grade, having a thickness between 0.2 and up to 1 mm and a required width of 90-110 mm, providing for the double seaming locks;

(b) feeding the slit coils into forming rolls, which gives the slits the desired near round shape with a diameter of 13 to 40 mm, preferably between 19 and 34 mm;

(c) filling reactive aluminum powder/granules or other de-oxidants from bunkers or feeders into the blank spaces of the wire;

(d) sealing the powder/granule filled wire, either singly or doubly, by the time it comes out of the last forming roll;

(e) squeezing the contents of the cored wire by squeezing rolls to reduce the diameter of the cored wire and impart dimensional strength and stability;

(f) coiling the thus formed wire over a mandrel with inner diameter varying from 200 mm to 2.5 meters in diameter, generally of around 1 meter in diameter, depending on customer requirement;

(g) applying a thin film of oil or anti-rust solution to the exposed surface or outer layer of the coil to prevent rust formation; and (h) strapping and/or wrapping the coils with plastic/stretch film for preventing moisture ingress, and then placing over wooden or steel pallets for delivery to the customer.

As pointed out earlier, de-oxidants may be selected from metallic, aluminum, titanium, zirconium and calcium silicide, but aluminum has been found to give best results, as the oxide formed may be removed easily due to phase separation and its refractoriness. Aluminum is used in granular or powdery form, coated with graphite. Scrap aluminum obtained from discarded used beverage cans, sheets/foils/strips/old electrical cable and the like are smelted or shredded and converted into granular form followed by application of a protective coating material like graphite, talc, limestone dust, calcite, steatite, LDP (low density polyethylene) and the like to prevent fusion or adhesion of granules at the time of being pressed and drawn into the wire. The lacquer coating on the used beverage cans also serves the purpose of protective coating. The size of aluminum granules should optimally be around 40 mesh, but finer or coarser sized granules may just as well be used. However, care should be taken to prevent handling loss. While drawing the aluminum granule-filled wire through the forming machine, the contents become tightly packed, thereby imparting dimensional rigidity and stiffness to the wire, ensuring ease of handling the coil.

De-oxidation with aluminum by changing the form of aluminum addition, which is carried out by injecting high dimensional cored wire filled with highly reactive aluminum in fine granular form and coated with an organic material like graphite for better recovery, and achieving the optimum level of oxygen and aluminum with lesser consumption of aluminum are a unique feature of this invention. The coating is not limited to organic materials but can also include inorganic coating materials like calcium oxide, talc, chalk powder, and the like. De-oxidation in accordance with the present invention can be carried out both in the primary and the secondary levels, as per requirement of the steel maker.

As pointed out earlier, aluminum powder is converted into fine granules and then coated with an inert organic coating material, like graphite flakes or any organic or inorganic coating material, to prevent the aluminum powder from sticking and fusing into a single mass while being pressed and drawn into the wire. While drawing the aluminum powder filled wire, the contents become tightly packed, thereby imparting dimensional rigidity and stiffness to the wire. This also ensures ease of handling the coil.

A notable feature of this invention is to use scrap aluminum of any grade in granular or powdered form as the de-oxidant, suitably coated with organic or inorganic coating material as described hereinbefore. Use of scrap/waste aluminum bodies effectively adds to the economy of the overall process.

As an additional feature of this invention, winding of the powder filled coil is subjected to 'coreless coiling' so that the coil can be uncoiled from the inner diameter of the stationary coil, generally called a "flipping coil," either vertical or horizontal. The coil can also be made into a spool with a core made of either wooden, synthetic, metal or any such materials.

The novel product of this invention, namely, high dimensional cored wire filled with fine granules of aluminum powder coated with graphite and securely held inside, is provided with seaming locks. By 'high dimensional' it is implied that dimensions of the cored wire ranges between 13 and 40 mm, optimally between 19 mm and 34 mm, and the internal diameter of the wound wire over the mandrel may vary from 200 mm to 2.5 meters, and the weight of each coil may range from 1 MT to around 20 MT (MT—metric ton, usual abbreviation of which is t), depending on customer requirement.

The present invention will be further illustrated by the experimental data included in the following example, but it is to be understood that the invention is not restricted to the results given therein.

EXAMPLE

High Dimensional Cored Wire (Powder Density)

| Wire Diameter (mm) | Bulk Density (Min) g/cm$^3$ | Bulk Density (Max) g/cm$^3$ | Sheath Thickness (mm) | Fill Rate (Min) g/m | Fill Rate (Max) g/m |
|---|---|---|---|---|---|
| 19 | 1.4 | 2.5 | 0.4 | 364 | 650 |
| 20 | 1.4 | 2.5 | 0.4 | 405 | 724 |
| 21 | 1.4 | 2.5 | 0.4 | 449 | 801 |
| 22 | 1.4 | 2.5 | 0.4 | 494 | 883 |
| 23 | 1.4 | 2.5 | 0.4 | 542 | 968 |
| 24 | 1.4 | 2.5 | 0.4 | 592 | 1057 |
| 25 | 1.4 | 2.5 | 0.4 | 644 | 1150 |
| 26 | 1.4 | 2.5 | 0.4 | 698 | 1247 |
| 27 | 1.4 | 2.5 | 0.4 | 755 | 1348 |
| 28 | 1.4 | 2.5 | 0.4 | 814 | 1453 |
| 29 | 1.4 | 2.5 | 0.4 | 875 | 1562 |
| 30 | 1.4 | 2.5 | 0.4 | 938 | 1674 |
| 31 | 1.4 | 2.5 | 0.4 | 1003 | 1791 |
| 32 | 1.4 | 2.5 | 0.4 | 1070 | 1912 |
| 33 | 1.4 | 2.5 | 0.4 | 1140 | 2036 |
| 34 | 1.4 | 2.5 | 0.4 | 1212 | 2165 |
| 35 | 1.4 | 2.5 | 0.4 | 1286 | 2297 |
| 36 | 1.4 | 2.5 | 0.4 | 1363 | 2433 |
| 37 | 1.4 | 2.5 | 0.4 | 1441 | 2573 |
| 38 | 1.4 | 2.5 | 0.4 | 1522 | 2718 |
| 39 | 1.4 | 2.5 | 0.4 | 1605 | 2866 |
| 40 | 1.4 | 2.5 | 0.4 | 1690 | 3018 |

Various advantages of the products of the present invention may be briefly outlined as follows:

1. An increasing amount of de-oxidant, like aluminum, can be filled per unit length of wire, and as more material is compacted per meter of wire of larger dimension, the cost of the steel sheathing becomes less.
2. There is a substantial rise in the feeding rate, thereby saving feeding time and resulting in an enhanced time available for steel making.
3. Due to larger dimension, better rigidity and stiffness, the high dimensional wire allows for deeper penetration into steel, thereby resulting in better recovery and homogenization of aluminum.
4. Graphite coated fine granules of aluminum are used as filler material for making high dimensional cored wire (known as "REACTIVE ALUMINUM"), which results in an estimated 15-25% higher recovery than the conventional solid aluminum wire. The reactivity is attained by smaller aluminum grains and hence larger surface area for reaction. The recovery can even be more depending on the steel making practices over the current system in vogue for aluminum addition into molten steel.
5. Since the aluminum cored wire is of "flipping type," there is a saving on the conversion cost in converting the solid aluminum wire into "flipping type".
6. Lesser consumption of aluminum will in turn reduce the production cost of steel, particularly in view of the use of scrap aluminum of any grade and coated with protective coated material.
7. Less consumption of packing material brings down production cost.

As the present invention may be embodied in several forms without departing from the spirit or essential characteristics thereof, it should also be understood that the above-described experimental data are not limited by any of the details of the foregoing description, unless otherwise specified, but rather should be construed broadly within its spirit and ambit as defined in the claims appended hereinafter, and therefore all changes and modifications that fall within the metes and bounds of the claims, or equivalences of such metes and bounds, are therefore intended to be embraced by the appended claims.

The invention claimed is:

1. A method of de-oxidizing steel, the method comprising adding to the steel during a steel-making process a high dimensional cored wire comprising a sheath and a de-oxidant material arranged in a core of the wire, the de-oxidant material comprising finely divided granules of aluminum powder coated with graphite, the cored wire having a diameter between 13 and 40 mm.

2. The method according to claim 1, wherein the sheath of the high dimensional cored wire is formed from steel sheet.

3. The method according to claim 2, wherein the sheath of the high dimensional cored wire is formed from cold-rolled steel sheet.

4. The method according to claim 3, wherein the coated de-oxidant material arranged in the core of the high dimensional cored wire is held in place in compacted form by a seaming lock provided during formation of the cored wire.

5. The method according to claim 2, wherein the sheath of the high dimensional cored wire comprises at least one seaming lock.

6. The method according to claim 5, wherein the at least one seaming lock is arranged parallel to a longitudinal axis of the of the high dimensional cored wire.

7. The method according to claim 5, wherein the coated de-oxidant material is held in place in compacted form by the seaming lock provided during formation of the high dimensional cored wire after filling.

8. The method according to claim 1, wherein the diameter of the high dimensional cored wire is between 19 and 34 mm.

9. The method according to claim 1, wherein the finely divided granules of aluminum powder are tightly packed, such that the granules impart dimensional rigidity and stiffness to the wire to ensuring ease of handling a coil of the wire.

10. The method according to claim 1, wherein the high dimensional cored wire is prepared by a process comprising the steps of:

(a) slitting cold rolled steel sheet having a thickness of between 0.2 and 1 mm and a width of 90-110 mm to provide for double seaming locks;

(b) feeding the slit sheets into forming rolls to give the slit sheets a desired near-round shape having a desired diameter;

(c) filling the de-oxidant material from bunkers or feeders into blank spaces of the sheath formed from the near round slit sheets;

(d) sealing the filled sheath, either singly or doubly, by a time the resulting cored wire comes out of a last one of the forming rolls;

(e) squeezing the de-oxidant material of the cored wire by squeezing rolls to reduce the diameter of the cored wire to 13 to 40 mm and to impart dimensional strength and stability;

(f) coiling the thus formed cored wire over a mandrel to a coil having an inner diameter from 200 mm to 2.5 meters;

(g) applying a thin film of oil or anti-rust solution to an exposed surface or outer layer of the coil to prevent rust formation; and (h) strapping and/or wrapping the coil with plastic/stretch film for preventing moisture ingress and then placing the coil over a wooden or steel pallet for delivery to a customer.

11. The method according to claim 10, wherein the cold-rolled steel sheet has a thickness of 0.4 mm, and wherein the coil has a weight between 1 MT and 20 MT.

12. The method according to claim 10, wherein the wire is coiled over a mandrel having a diameter of about 1 m.

13. The method according to claim 10, wherein the de-oxidant filled wire is subjected to coreless winding, such that the coil may be unwound or uncoiled from an inner diameter of the coil.

14. A method of de-oxidizing steel, the method comprising adding to the steel during a steel-making process a high dimensional cored wire comprising a sheath and a de-oxidant material arranged in a core of the wire, the de-oxidant material being in finely divided granular or powdery form coated with a protective coating material and being formed from scrap aluminum, the cored wire having a diameter between 13 and 40 mm.

15. The method according claim 14, wherein the scrap aluminum is in a form of sheets, foils, or strips.

16. The method according to claim 14, wherein the scrap aluminum is converted by a mechanical or melting process to finely divided granules or powder.

17. The method according to claim 14, wherein the scrap aluminum is shredded and converted into granular/powdery form.

18. The method according to claim 14, wherein the protective coating material comprises at least one selected from graphite, talc, steatite, limestone dust, calcite, and low density polyethylene.

19. The method according to claim 14, wherein the sheath of the high dimensional cored wire is formed from steel sheet.

20. The method according to claim 14, wherein the diameter of the high dimensional cored wire is between 19 and 34 mm.

* * * * *